US010821617B2

(12) United States Patent
Hitson

(10) Patent No.: US 10,821,617 B2
(45) Date of Patent: Nov. 3, 2020

(54) ANIMAL SHEARS/CLIPPERS

(71) Applicant: Nathan Hitson, West Milton, OH (US)

(72) Inventor: Nathan Hitson, West Milton, OH (US)

( * ) Notice: Subject to any disclaimer, the term of this patent is extended or adjusted under 35 U.S.C. 154(b) by 241 days.

(21) Appl. No.: 15/193,312

(22) Filed: Jun. 27, 2016

(65) Prior Publication Data

US 2017/0203450 A1 Jul. 20, 2017

Related U.S. Application Data

(60) Provisional application No. 62/278,772, filed on Jan. 14, 2016.

(51) Int. Cl.
*B26B 19/24* (2006.01)
*B26B 19/38* (2006.01)
*B26B 19/28* (2006.01)

(52) U.S. Cl.
CPC ..... *B26B 19/24* (2013.01); *B26B 19/28* (2013.01); *B26B 19/3853* (2013.01); *B26B 19/3873* (2013.01)

(58) Field of Classification Search
CPC ..... B26B 19/24; B26B 19/28; B26B 19/282; B26B 19/284
USPC ..... 30/208–216
See application file for complete search history.

(56) References Cited

U.S. PATENT DOCUMENTS 2,722,052 A * 11/1955 Frey ..... B26B 19/24 30/215
3,136,058 A * 6/1964 Andis ..... B26B 19/282 30/210
3,259,770 A * 7/1966 Mattson ..... B26B 19/24 30/43
3,988,828 A * 11/1976 Geary ..... B26B 19/24 30/123.3
4,094,065 A * 6/1978 Geary ..... B26B 15/00 30/123.3
4,221,050 A * 9/1980 Walter ..... B26B 19/06 30/216
4,291,462 A * 9/1981 Corder ..... B26B 19/24 30/221
4,532,707 A * 8/1985 Allen ..... B26B 19/24 30/200
4,782,592 A * 11/1988 Altamore ..... B26B 19/06 30/195
4,785,537 A * 11/1988 Moran ..... B26B 19/24 30/219
5,068,966 A * 12/1991 Wahl ..... B26B 19/06 30/220
5,259,116 A * 11/1993 Laube ..... B26B 19/24 30/209
6,073,350 A * 6/2000 Elston ..... B26B 19/06 30/216
6,282,797 B1 * 9/2001 Osada ..... B23D 49/165 30/392

(Continued)

*Primary Examiner* — Andrea L Wellington
*Assistant Examiner* — Richard D Crosby, Jr.
(74) *Attorney, Agent, or Firm* — Venjuris, P.C.

(57) ABSTRACT

A cordless animal shearing/clipping device is disclosed. The cordless shear/clipper includes a shear portion and a handle portion. The shear portion includes a shear or clipping head interface that allows for an interchangeable shear/clipper head to be coupled to the shear head interface. The handle portion includes a motor casing, a switch, and a battery slide. This design allows for easy, safe, and efficient shearing of animal fibers in any location.

11 Claims, 11 Drawing Sheets

(56) References Cited

U.S. PATENT DOCUMENTS 6,559,563 B1 * 5/2003 Shimizu ..... H02K 33/10 30/43.92
7,053,507 B2 * 5/2006 Kobayashi ..... B26B 19/282 310/15
7,080,458 B2 * 7/2006 Andis ..... B26B 19/06 30/208
7,334,338 B2 * 2/2008 Shiba ..... B26B 19/04 30/346.51
7,624,506 B2 * 12/2009 Melton ..... B26B 19/06 30/210
7,762,000 B2 * 7/2010 Williams ..... A01K 14/00 30/122
7,992,303 B2 * 8/2011 Liao ..... B26B 19/205 30/200
8,359,755 B1 * 1/2013 Laube ..... A01K 13/002 119/611
8,533,962 B1 * 9/2013 Laube ..... B26B 19/28 30/210
8,769,824 B2 * 7/2014 Heerlein ..... B26B 19/24 30/216
8,813,377 B2 * 8/2014 Kani ..... B23D 49/162 30/393
2005/0060893 A1 * 3/2005 Comminges ..... B26B 19/28 30/216
2006/0059696 A1 * 3/2006 Derby ..... B26B 19/06 30/210
2007/0050991 A1 * 3/2007 Mooney ..... A01G 3/053 30/210
2008/0263871 A1 * 10/2008 Liao ..... B26B 19/28 30/201
2012/0297632 A1 * 11/2012 Ogura ..... B23D 49/162 30/392
2014/0366383 A1 * 12/2014 Dyer ..... B23Q 11/127 30/123
2015/0343653 A1 * 12/2015 Griffiths ..... A01K 13/00 119/601
2017/0203450 A1 * 7/2017 Hitson ..... B26B 19/24

* cited by examiner

ANIMAL SHEARS/CLIPPERS

FIELD OF THE INVENTION

The present invention relates generally to animal shears/clippers, and more particularly, to cordless animal shears/clippers that include a brushless DC motor, interchangeable shear heads, and a rechargeable battery pack. The motor and interchangeable shear heads allow the cordless shears/clippers to be powerful enough to shear large livestock animals in a safe, manageable, and efficient way.

BACKGROUND OF THE INVENTION

Animal shears/clippers have been used in the livestock industry for many years. The shears/clippers are typically used by individuals to remove the coats and fibers of animals for various reasons including, but not limited to, showing purposes, gathering of the animals' fibers for use in the textile industry, commercial production industry, etc. In many livestock industries and the show stock industry, safety is compromised with the use of traditional corded shears/clippers. While running the traditional style of shears/clippers, the cord can become entangled in an animal's legs or the shearer's legs and cause a running shear/clipper to be jerked from the shearer's hand. This can cause injury to the animal or the shearer. Older cords can become frayed or cracked, which is a danger to both the shearer and the animals, especially with the common presence of water around the shearing/clipping areas. These scenarios present very hazardous conditions to the animals and the shearers. The current invention of cordless livestock shears/clippers remove the cord from the shearing/clipping area, thus limiting or outright eliminating the hazards discussed above. The removable batteries slide off of the shear/clipper and the charger can be placed in a safe location away from water and other elements to which traditional cords are exposed.

The current invention relating to cordless livestock shears provides mobility that is virtually impossible with corded shears/clippers. The cordless shears/clippers can be used in places with no electrical outlets—in a field, in the pen far away from the outlets, in a livestock trailer, or chute. In addition to mobility, the cordless shears/clippers also provide more flexibility of use. Without a cord, a shearer is not as limited in his movements as he shears/clips an animal. The shearer can work more quickly, without always watching for the cord making sure it is long enough to reach or that it is not tangled up. These advantages provide additional safety for the animals and the shearers as they are working.

The current shears/clippers are used primarily in the show industry or livestock production, however, they can be adapted for any shearing/clipping use. The shears/clippers combine a powerful custom brushless direct current motor with battery technology to provide the power necessary to run effective oscillating shears/clippers. The shears/clippers also provide the flexibility of using a cordless tool. The cordless livestock shears/clippers are designed to be used with either shearing (oscillating motion) or clipping (linear motion) style heads. The heads are dependent on the application in which the shears/clippers are being used and are readily interchangeable.

SUMMARY OF THE INVENTION

As such, the present invention is directed to a cordless animal shear/clipper that effectively and safely allows a user to shear/clip an animal without an obstructive or dangerous cord.

The current invention includes a shear portion including a shear head interface, wherein an interchangeable shear head couples to the shear portion via the shear head interface, and a handle portion including a motor casing, a switch, and a battery slide, wherein the battery slide receives a removable battery and the motor casing houses a brushless direct current motor.

It is an object of the present invention to provide a cordless shear/clipper device that can be used for livestock and industrial purposes.

It is a further object of the present invention to provide a cordless shear/clipper device that can safely operate for extended periods of time without recharging the battery.

It is a further object of the present invention to provide a cordless shear/clipper device that allows for interchangeable shear heads.

It is a further object of the present invention to provide a cordless shear/clipper with a motor with a fan integrated into the motor housing to prevent overheating and extended use.

DESCRIPTION OF PREFERRED EMBODIMENTS

Figure 2:
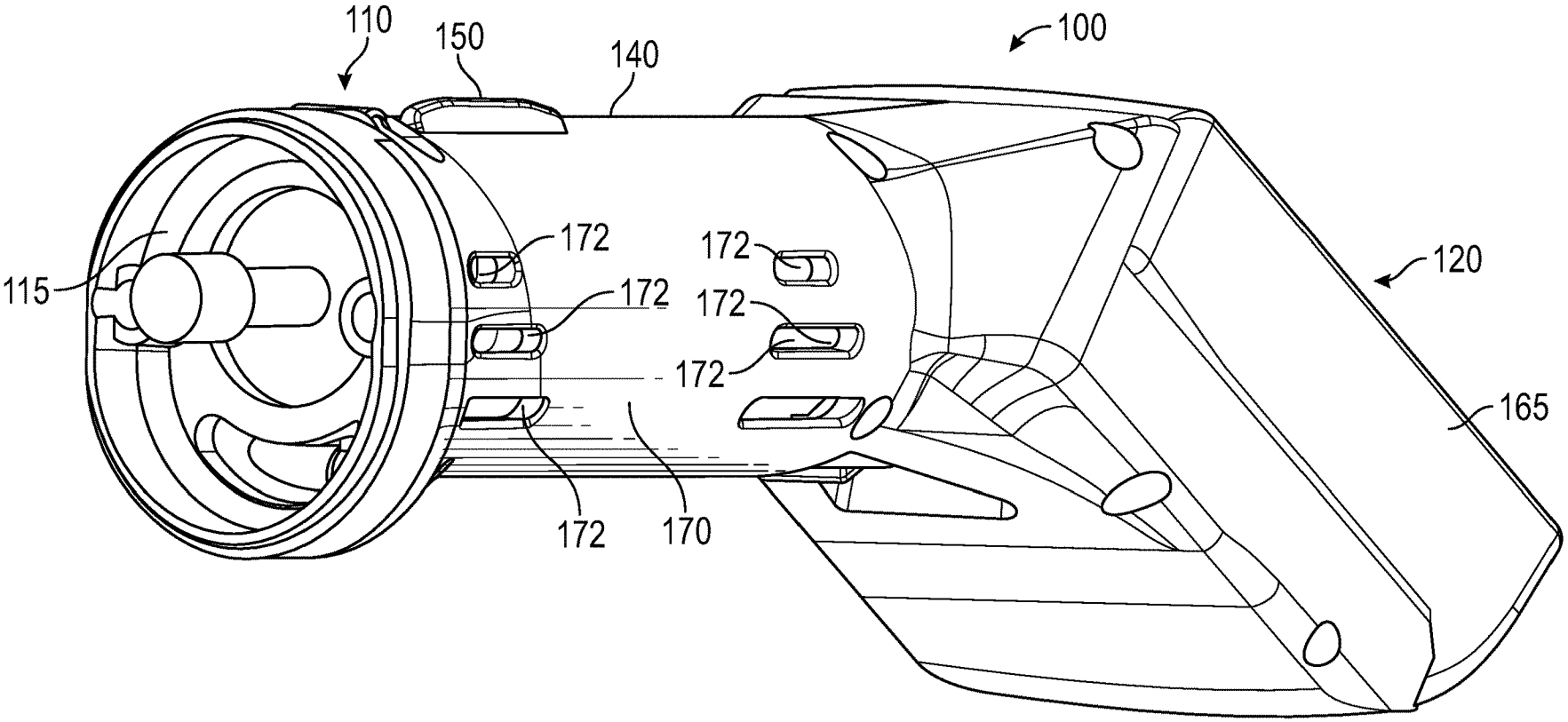
FIG. 2 is a perspective view of a preferred embodiment of a shear/clipper with no attached shear head.
Figure 3:
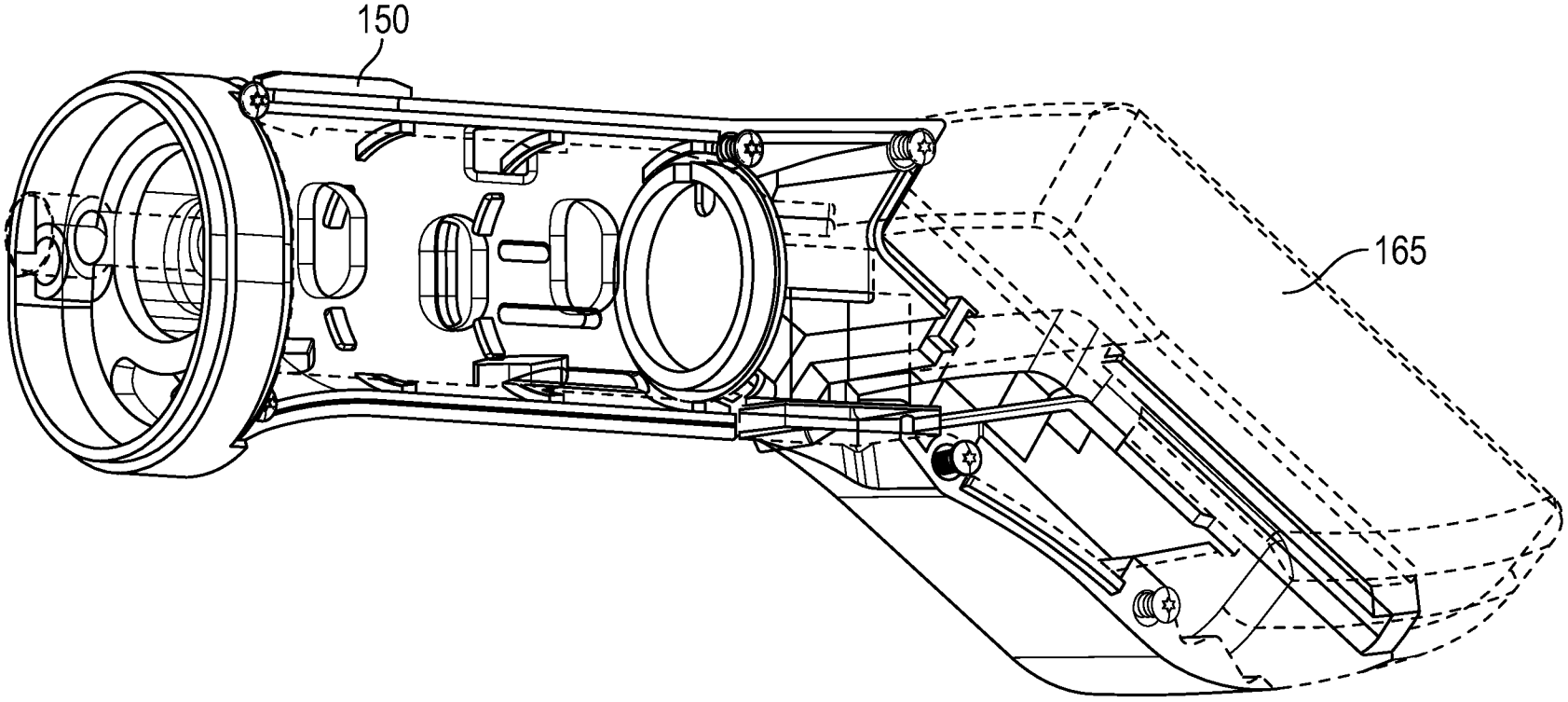
FIG. 3 is a perspective view of the preferred embodiment of the invention with a view of the inner portion of the motor casing and handle.
Figure 4:
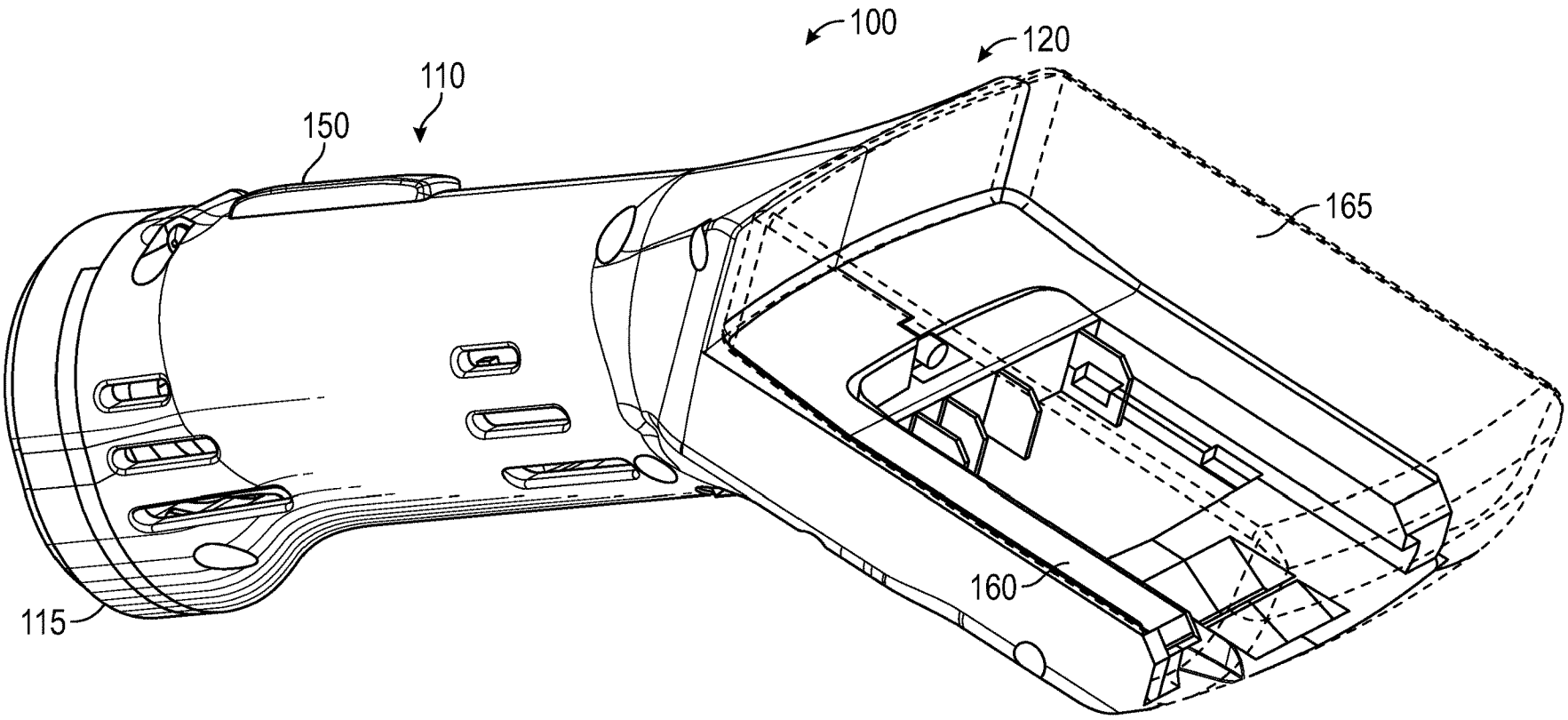
FIG. 4 is a view showing the battery slide and dotted lines where the rechargeable battery fits.
Figure 5:
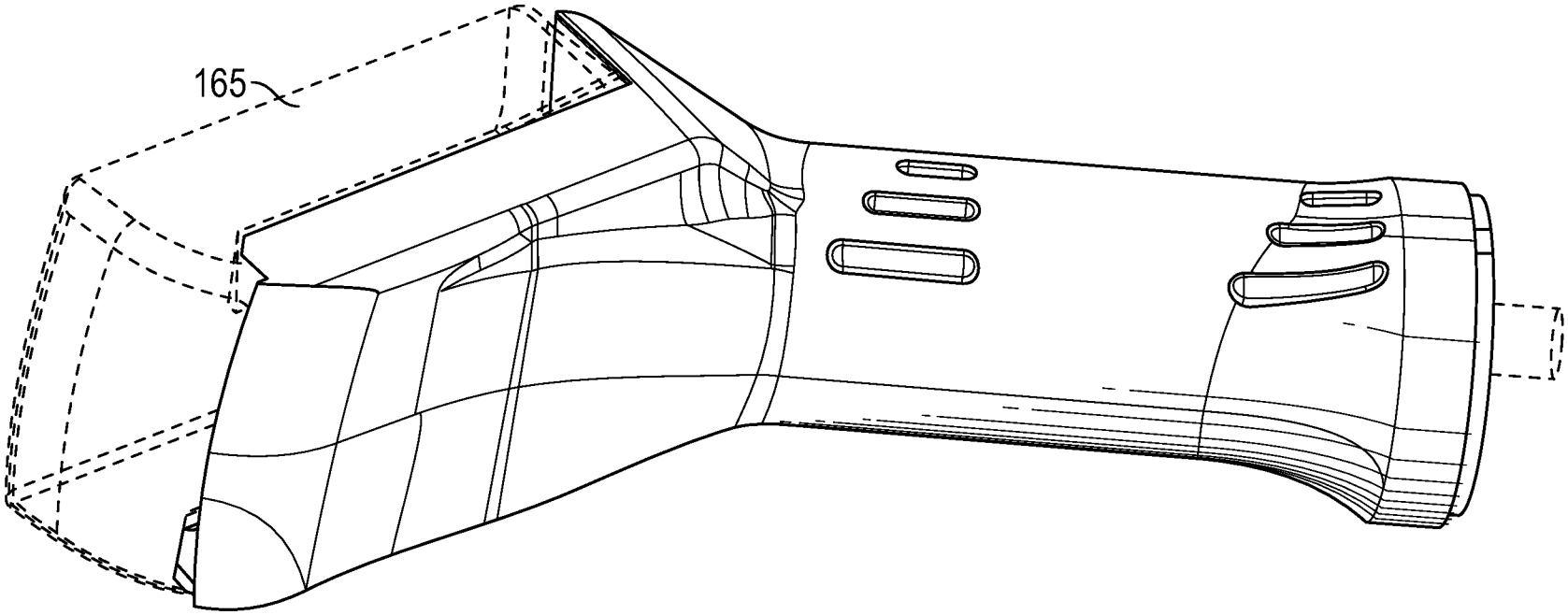
FIG. 5 is an underside view of the shear/clipper device.
Figure 6:
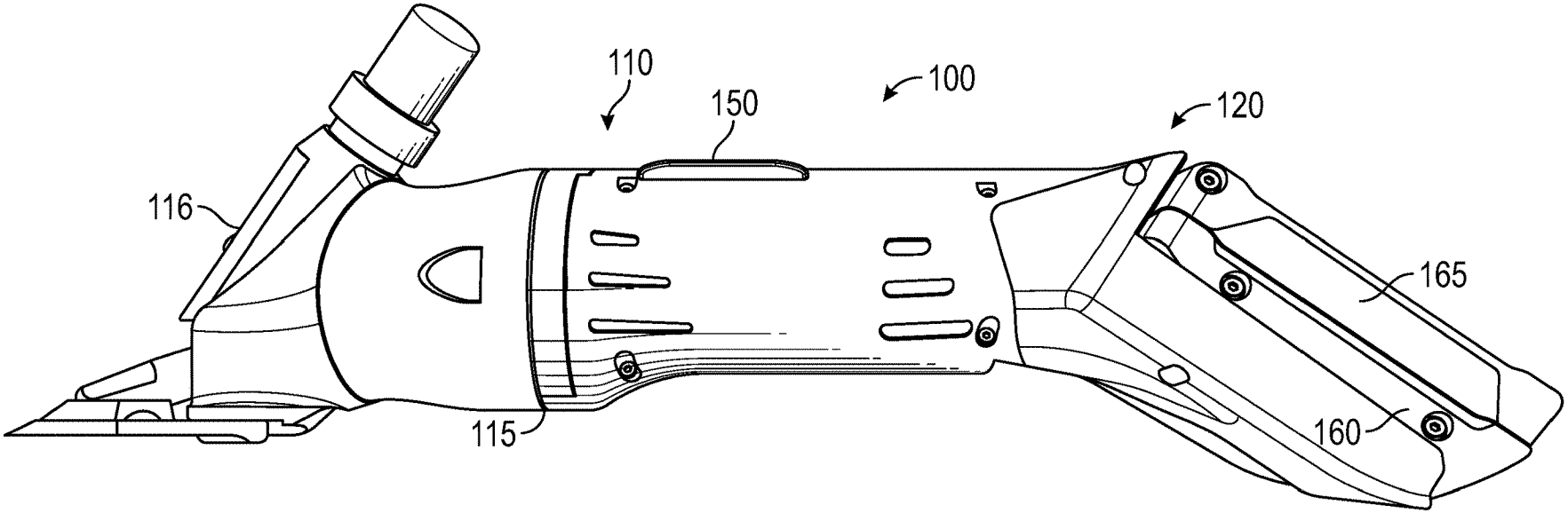
FIG. 6 is a side view showing the shear device with an attached shear head.
Figure 7:
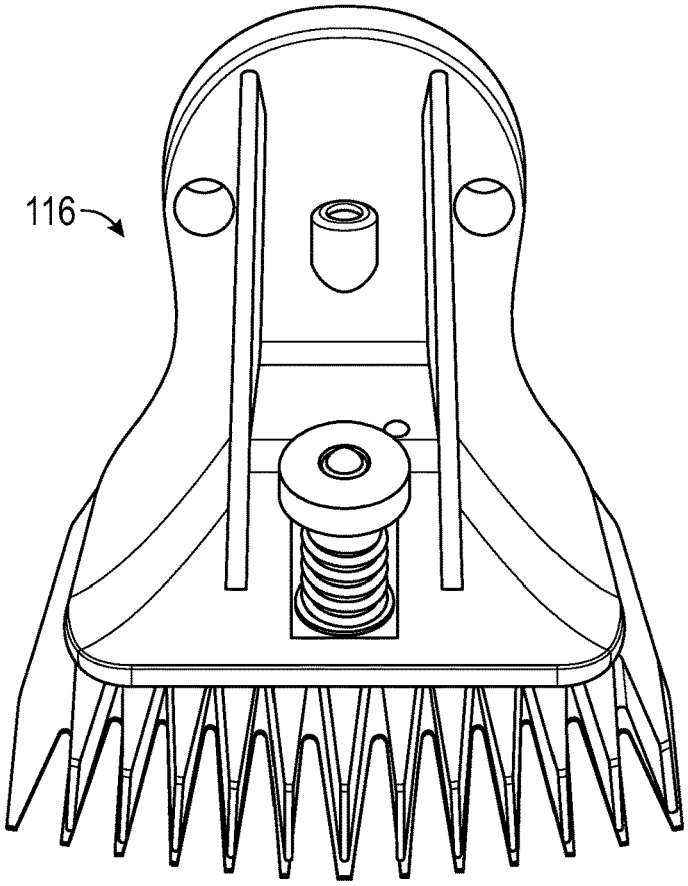
FIG. 7 is a preferred embodiment of a clipping head.

The present invention relates to a cordless shear/clipper 100 that provides mobility and efficiency that is virtually impossible with corded shears. As can be seen in FIG. 2, the preferred embodiment of the cordless shears 100 includes a shear portion 110 and a handle portion 120. The shear portion 110 includes a shear head interface 115 that allows for an interchangeable shear head 116 or clipping head 117 to be coupled to the head interface 115. The handle portion 120 includes a motor casing 140, a switch 150, and a battery slide connection 160.

The battery slide connection 160 receives a removable, rechargeable battery 165. In the preferred embodiment of the invention, the removable battery is a rechargeable 18 volt battery with optional amps. A more preferred embodiment includes a rechargeable 18 volt lithium ion battery, and the most preferred embodiment includes a BOSCH® Model BAT612, BAT620, or BAT622 rechargeable battery. This is the preferred battery because it is inexpensive, highly reliable, available worldwide in 110 and 220 volts, and has a standard charger that is readily available.

Figure 1A:
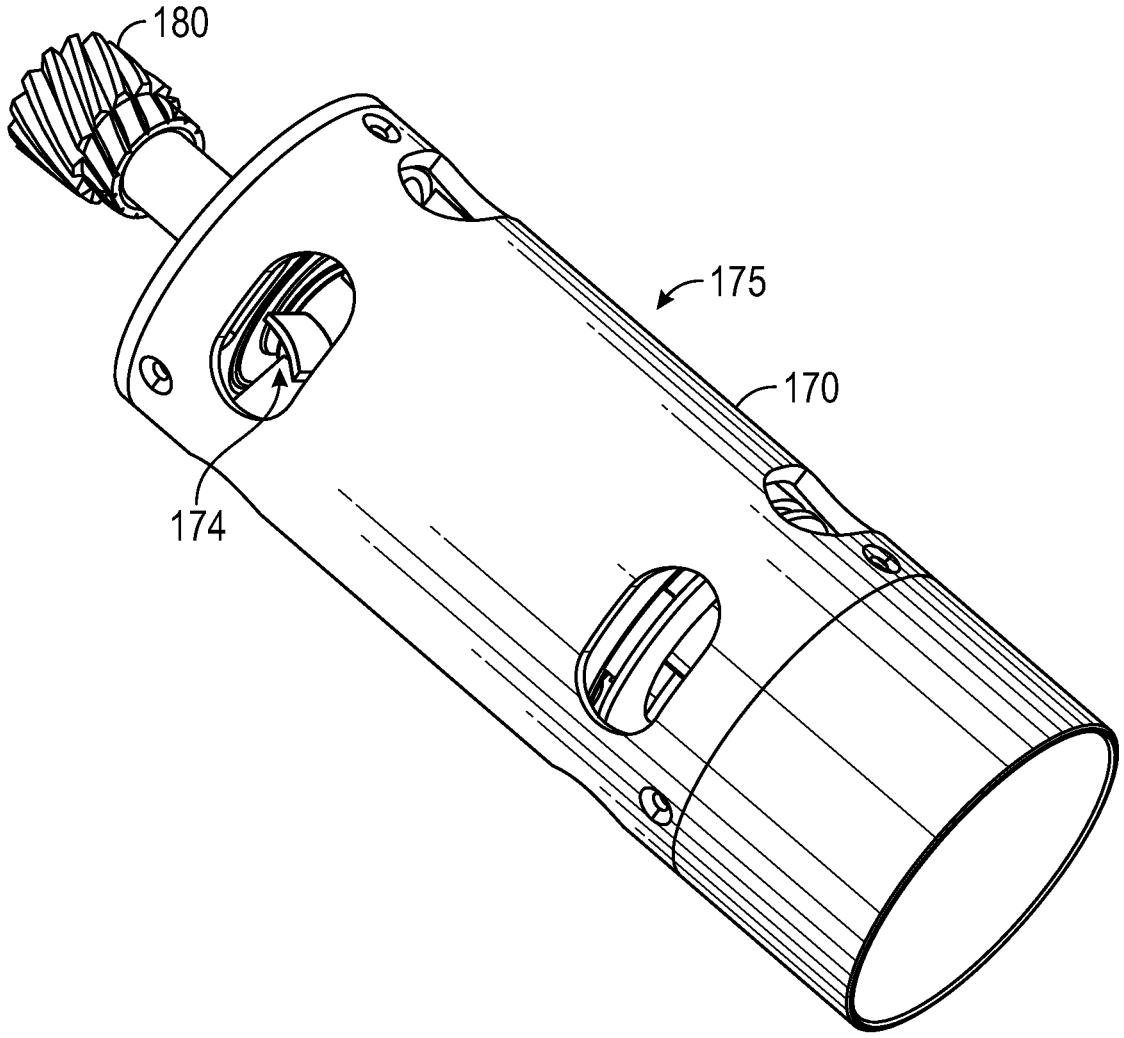
FIG. 1A is a perspective view of a preferred embodiment of a brushless DC motor.

The motor casing 170 houses a brushless direct current motor 175. It is preferred that the motor casing 170 be made from reinforced resin fiberglass. This type of material provides high mechanical and thermal strength. The enhanced mechanical strength of the motor casing 170 causes the mechanical impact generated by the shear heads 116 to be less to the device and ultimately the user. The preferred motor casing 170 is made by injection molding. The motor casing 170 further includes integrated ventilation openings 172 that allow for the continued flow of cooling air generated by a fan integrated 174 into the housing 173 of the brushless DC motor 175 as shown in FIG. 1*a*. The integrated fan 174 and ventilation openings 172 allow for the motor 175 to run more efficiently and for longer periods of time than motors without the integrated cooling fan 174.

In the preferred embodiment of the invention, the brushless DC motor has low heat generation for two reasons. First, there is a high electric efficiency caused by the fact that there are no brushes to cause friction and, therefore, heat. Second, there is an integrated fan 174 built into the housing of the motor. Continued operation of the motor 175 is possible for hours because of its increased efficiency. This continuous operation and efficiency allows for an entire sheep or other livestock animal to be sheared in one period of time without stopping to change shears and/or batteries. If the preferred battery is being used, the sheer 100 can operate for a longer amount of time than the battery takes to recharge. In the preferred embodiment, the shear 100 can be operated for more than an hour, and the time to recharge the battery 165 is less than half of an hour. This continuous operation is possible with only two interchangeable batteries.

Figure 1B:
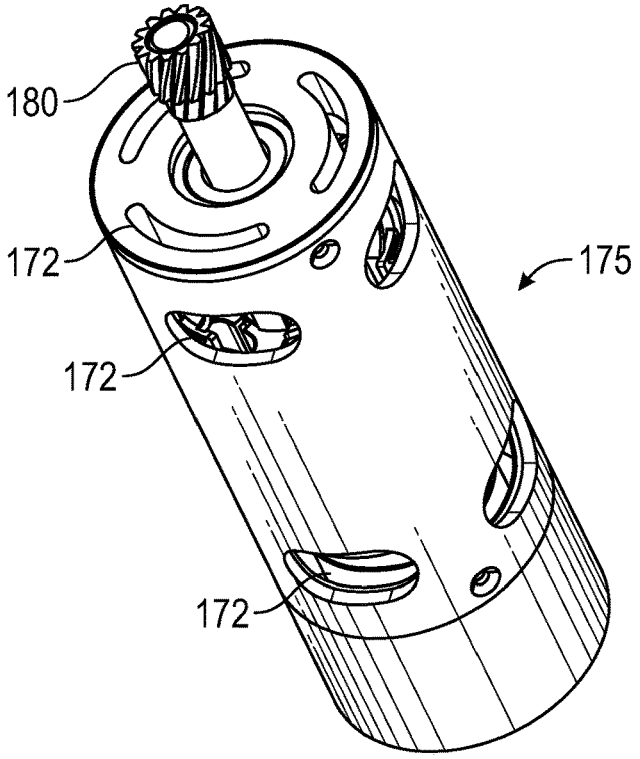
FIG. 1B is second view of the brushless DC motor of FIG. 1A.
Figure 1C:
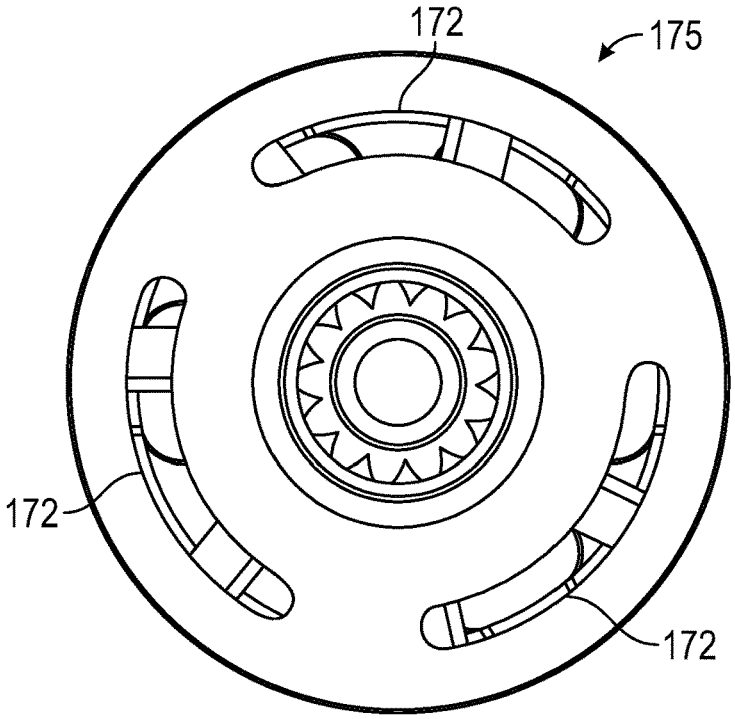
FIG. 1C is a first end view of the brushless DC motor of FIG. 1A.
Figure 1D:
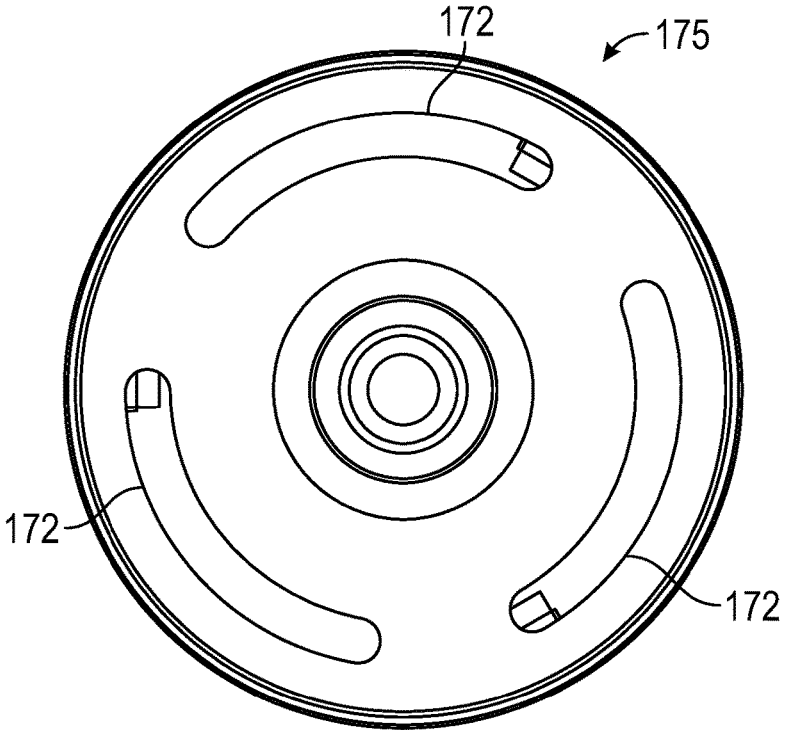
FIG. 1D is a second end view of the brushless DC motor of FIG. 1A.
Figure 1E:
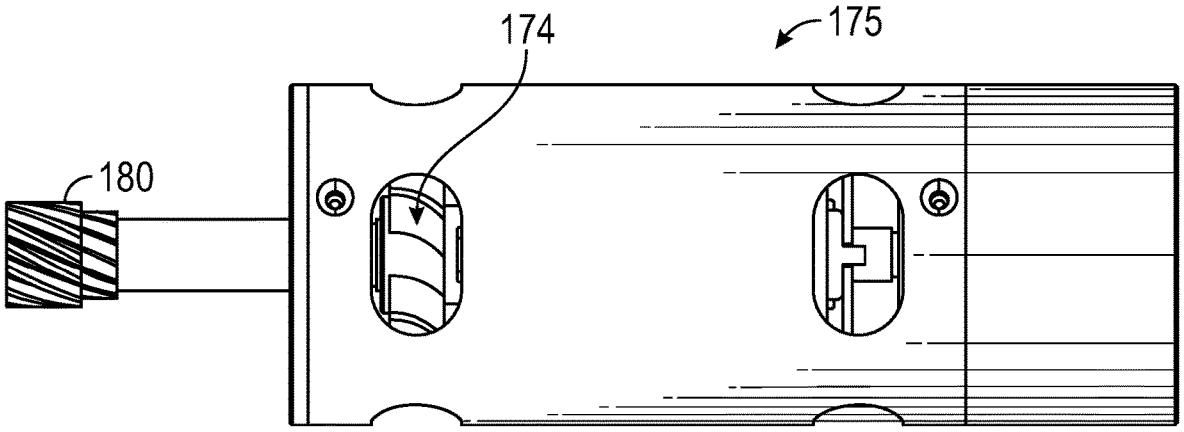
FIG. 1E is a side view of the brushless DC motor of FIG. 1A.
Figure 8:
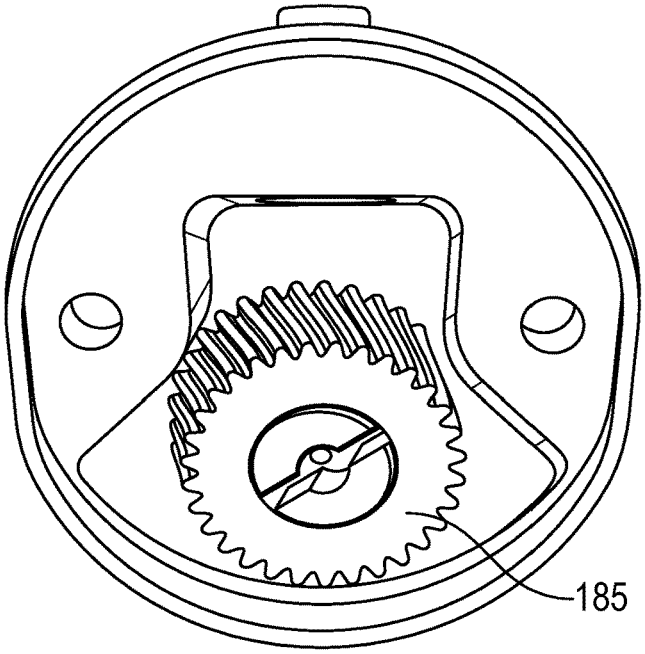
FIG. 8 is the back side of the clipping head of FIG. 7 that fits into the shear head interface.
Figure 9:
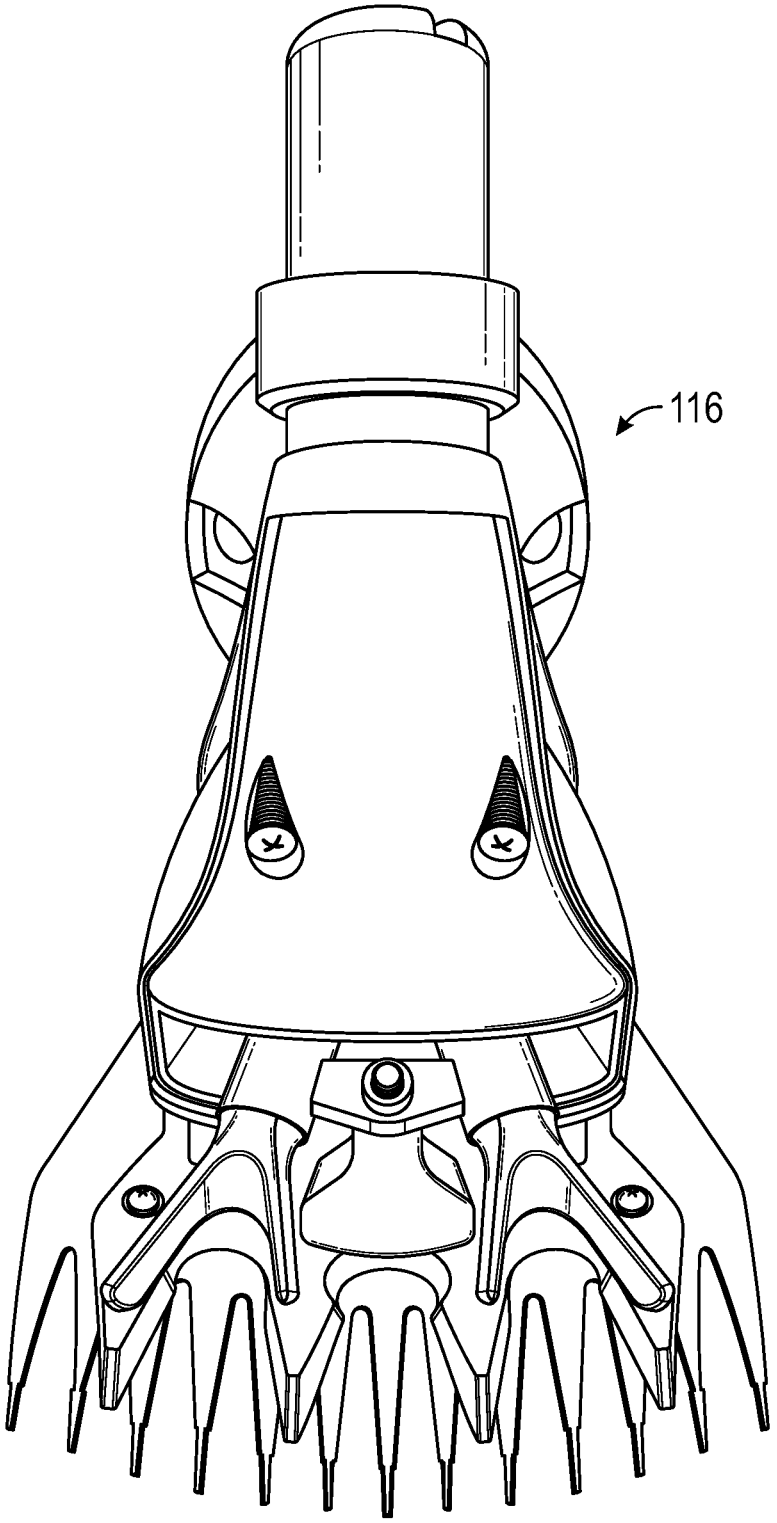
FIG. 9 is another preferred embodiment of a shear head.
Figure 10:
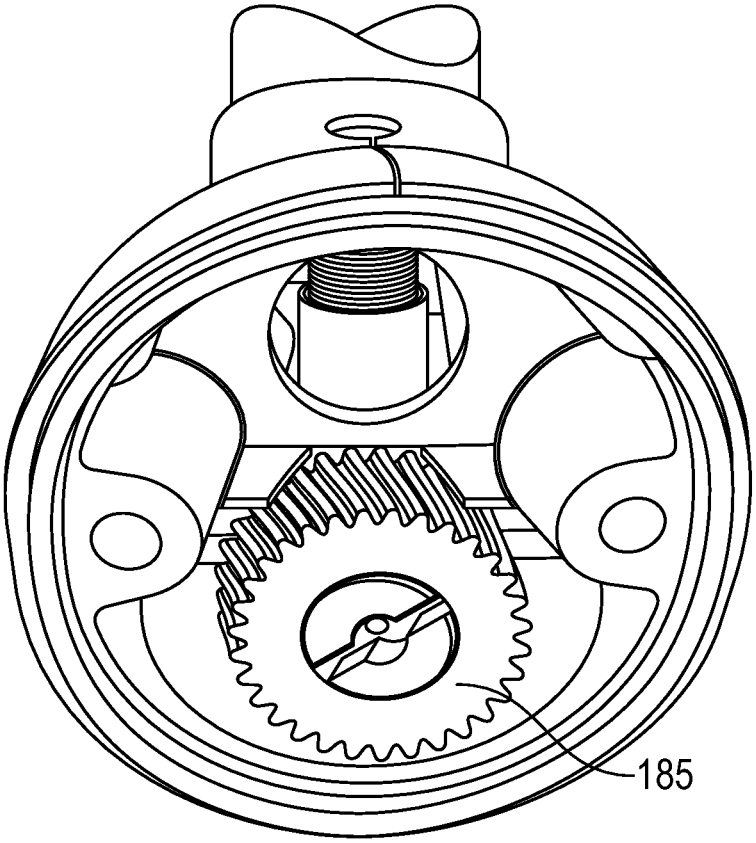
FIG. 10 is the back side of the shear head of FIG. 9 that fits into the shear head interface.

The brushless DC motor 175 includes a pre-settable revolution speed and high torque. No additional gear, other than the helical gear 180 shown in FIGS. 1A, 1B, and 1E is needed in the motor 175 to achieve this revolution speed and driving torque required by the shear head 116. As shown in the FIGS. 1A, 1B, and 1E, the helical gear 180 is a straight shaft helical gear 180 that is press fit in line with the DC motor 175. The helical gear 180 fits into a mating helical gear 185 within the shear head 116 shown in FIGS. 8 and 10. The mating of the helical gears 180 and 185 provides gear on gear motion to cause motion of the shear head 116 or clipper head 117. The compact design of the motor 175 allows for reduced length of the drive portion of the motor 175. The brushless motor 175 is also preferred in that it does not require consumable brushes. Thus, the motor 175 can continuously function without needing replacement parts or maintenance.

The handle portion 120 of the shear 100 further includes an on/off switch 150 that is located on top of the handle portion 120 of the shear 100 to control the motor 175. In an alternate embodiment of the invention, the handle portion 120 of the shear/clipper 100 further includes a rubber layer between the motor 175 and the motor casing 170 to reduce the vibration of the shear/clipper device 100. The reduced vibration allows the operator to operate the shear 100 more comfortably and efficiently.

In the preferred embodiment of the invention, the shear head interface 115 is sized in such a way that it allows for multiple types of shear heads 116 or clipping heads 117 to be used with the cordless shear/clipper 100. These shear heads 116 or clipper heads 117 couple to the drive shaft of the motor 175 that provides the operational movement of the shear heads 116 or clipper heads 117. As described above, the shear heads 116 or clipper heads 117 are coupled to the drive shaft of the motor 175 via the helical gears 180 and 185 located on the shear head interface 115 of the drive shaft of the motor 175 and the shear head 116 or clipper head 117, respectively.

The preferred embodiment of the invention is described in the Description of Preferred Embodiments. While these descriptions directly describe the one embodiment, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A shear comprising:

a shear portion including a shear head interface, wherein an interchangeable shear or clipper head couples to the shear portion via the shear head interface;

a handle portion including a motor casing, a switch, and a battery slide, wherein the battery slide receives a removable battery and the motor casing houses a brushless direct current motor;

wherein the shear or clipper head couples to the shear portion of the shear via the shear head interface with a pair of helical gears that are integrated in the shear or clipper head and a drive shaft of the motor to create gear on gear motion of the shear or clipper head.

2. The shear of claim 1 wherein the removable battery is a lithium ion battery.

3. The shear of claim 1 wherein the brushless direct current motor includes an integrated cooling fan.

4. The shear of claim 1 further comprising integrated ventilation openings in the motor casing.

5. The shear of claim 1 wherein the motor casing is made of reinforced fiber glass resin.

6. The shear of claim 1 wherein revolution speed of the brushless direct current motor is pre-settable based on requirements of the interchangeable shear or clipper head.

7. A shear comprising:

a shear portion including a shear head interface, wherein an interchangeable shear or clipper head couples to the shear portion via the shear head interface;

a handle portion including a motor casing, a switch, and a battery slide, wherein the battery slide receives a removable battery and the motor casing houses a brushless direct current motor with an integrated cooling fan;

wherein the shear or clipper head couples to the shear portion of the shear via the shear head interface with a pair of helical gears that are integrated in the shear or clipper head and a drive shaft of the motor to create gear on gear motion of the shear or clipper head.

8. The shear of claim 7 wherein the removable battery is a lithium ion battery.

9. The shear of claim 7 further comprising ventilation openings in the motor casing.

10. The shear of claim 7 wherein the motor casing is made of reinforced fiber glass resin.

11. The shear of claim 7 wherein revolution speed of the brushless direct current motor is pre-settable based on requirements of the interchangeable shear or clipper head.

* * * * *